US005717279A

United States Patent [19]

Imura

[11] Patent Number: 5,717,279

[45] Date of Patent: Feb. 10, 1998

[54] FIELD EMISSION CATHODE WITH RESISTIVE GATE AREAS AND ELECTRON GUN USING SAME

[75] Inventor: Hironori Imura, Tokyo, Japan

[73] Assignee: NEC Corporation, Tokyo, Japan

[21] Appl. No.: 607,465

[22] Filed: Feb. 27, 1996

[30] Foreign Application Priority Data

Feb. 28, 1995 [JP] Japan ..... 7-040233

[51] Int. Cl.[6] ..... H01J 1/30; H01J 19/24

[52] U.S. Cl. ..... 313/336; 313/309; 313/495; 313/414; 313/447

[58] Field of Search ..... 313/309, 336, 313/351, 497, 495, 496, 414, 422, 447

[56] References Cited

U.S. PATENT DOCUMENTS

| | | | |
|---|---|---|---|
| 4,178,531 | 12/1979 | Alig | 313/409 |
| 5,319,279 | 6/1994 | Watanabe et al. | 313/309 |
| 5,396,150 | 3/1995 | Wu et al. | 313/495 |
| 5,514,847 | 5/1996 | Makishima et al. | 313/309 |
| 5,534,744 | 7/1996 | Leroux et al. | 313/309 |
| 5,559,390 | 9/1996 | Makishima et al. | 313/309 |
| 5,578,900 | 11/1996 | Peng et al. | 313/495 |

FOREIGN PATENT DOCUMENTS

| | | | |
|---|---|---|---|
| 4-284324 | 10/1992 | Japan | H01J 1/30 |
| 5-144370 | 6/1993 | Japan | H01J 1/30 |

OTHER PUBLICATIONS

C.A. Spindt, "A Thin-Film Field-Emission Cathode", *Journal of Applied Physics*, vol. 39, 1968, pp. 3504–3505.

*Primary Examiner*—Michael Horabik
*Assistant Examiner*—Michael Day
*Attorney, Agent, or Firm*—Sughrue, Mion, Zinn, Macpeak & Seas, PLLC

[57] ABSTRACT

A field emission cold cathode includes a conductive substrate (1), an insulating layer (2) disposed on the substrate (1), a gate electrode (3) disposed on the insulating layer (2), cavities (4) extending through the gate electrode (3) and the insulating layer (2), and emitter cones (6) disposed on the substrate (1) within the cavities (4). The gate electrode further includes high resistance areas (5) disposed around the tips of the emitter cones (6) that enables the field emission cold cathode to operate in the event of a short circuit between the gate electrode (3) and an emitter cone (6) due to electrically conductive foreign material entering a cavity (4). The field emission cold cathode can be use in an electron gun.

18 Claims, 6 Drawing Sheets

FIELD EMISSION CATHODE WITH RESISTIVE GATE AREAS AND ELECTRON GUN USING SAME

BACKGROUND OF THE INVENTION

1. Field of the Invention

The invention relates to a cold cathode acting as an electron source, and more particularly to a field emission type cold cathode emitting electrons through a sharp tip end thereof, and further to an electron gun including such a cathode.

2. Description of the Related Art

Various attempts have been made with respect to a field emission type cold cathode. For instance, C. A. Spindt has proposed a field emission type cold cathode to be manufactured on a silicon wafer by means of micro-machining techniques to which LSI fabrication technology is applied and by which a minute-sized device can be fabricated. Refer to Journal of Applied Physics, Vol. 39, pp. 3504–3505, 1968.

FIGS. 1A to 1D are cross-sectional views showing respective steps of a method of fabricating a cold cathode proposed by Spindt. Hereinbelow is explained each step in brief. With reference to FIG. 1A, there are deposited an insulative layer 2 having a thickness of 1 μm and a gate electrode 3 made of molybdenum (Mo) on an electrically conductive substrate 1 made of single crystal silicon. Then, cavities 4 each having an inner diameter of about 1.5 μm are formed through the insulative layer 2 and the gate electrode 3 so that the cavities 4 reach a surface of the substrate 1.

Then, as the electrically conductive substrate 1 is made to rotate about a normal line of the substrate 1 passing through a center of the substrate 1, a sacrifice layer 9 made of aluminum is deposited both on the gate electrode 3 and an upper part of a sidewall of the cavities 4 by vacuum evaporation at an angle of 70 degrees measured from the normal line of the substrate 1, as illustrated in FIG. 1B.

Then, as the electrically conductive substrate 1 is made to rotate again about the above mentioned normal line, refractory metal such as molybdenum (Mo) is deposited by vacuum evaporation in a direction of the above mentioned normal line. As a refractory metal layer 10 made of Mo is being deposited on the gate electrode 3, holes 10*a* formed in the refractory metal layer 10 above the cavities 4 are reduced in its inner diameter, because Mo also deposits on a sidewall of each of the holes 10*a*. Thus, the holes 10*a* are shaped in circular cones.

The refractory metal Mo having passed through the holes 10*a* formed in the refractory metal layer 10 deposits on a bottom surface of the cavities 4. As the holes 10*a* are reduced in their inner diameter, an area of deposited Mo is also reduced. By continuing deposition of Mo until the holes 10*a* of the refractory metal layer 10 are completely closed, the refractory metal Mo having been deposited on a bottom surface of the cavities 4 make circular cones 6 (hereinafter, referred to as "emitter cone"), as illustrated in FIG. 1C. Following the formation of the refractory metal layer 10, a resultant is emerged in weak acid such as phosphoric acid to thereby dissolve the sacrifice layer 9, which makes it possible to remove the refractory metal layer 10, for instance, by lift-off technique. Thus, there can be obtained a minute field emission type cold cathode as illustrated in FIG. 1D.

By applying a voltage ranging from a few tens of volts to 200 V across the substrate 1 and the gate electrode 3 so that positive voltage is applied to the gate electrode 3, there is generated an electric field having an intensity greater than $10^7$ V/cm at a sharp tip end of the emitter cone 6, and thus electrons are emitted from the tip end of the emitter cone 6.

Currently, it is possible to produce current of more than 100 μA per an emitter cone. Hence, various attempts have been made for application of the field emission type cold cathode as mentioned above. For instance, there have been proposed a switching device including a fine triode having the above mentioned cathode as electron source, and a display panel for generating fluorescent substance by using planar emission source including a plurality of the cathodes arranged in a matrix.

Japanese Unexamined Patent Publication No. 5-144370 has suggested a field emission type cold cathode including a gate electrode comprising two layers having different resistances. The cathode disclosed in No. 5-144370 is illustrated in FIGS. 2A and 2B; FIG. 2A is a plan view of the cathode, and FIG. 2B is a cross-sectional view taken along the line A—A of FIG. 2A. As illustrated, the cathode has a lot of emitter cones 15 divided into a plurality of groups, each group including 3×3 emitter cones. Each of the emitter cones 15 has a gate electrode composed of a high-resistance layer 16, and the emitter cones 15 are surrounded by a low-resistance layer 17.

FIG. 3 shows the tendency of operation characteristics of a field emission type cold cathode. The illustrated tendency is one observed when a voltage sufficient for emitting electrons from the emitter cone 6 is applied to the gate electrode 3. The abscissa represents a square root of a voltage (hereinafter referred to as "a collector voltage") to be applied to an electrode (hereinafter referred to as "a collector") disposed in facing relation and spaced away from a field emission type cold cathode by 2.5 mm, and receiving therein electrons emitted from the cathode, whereas the ordinate represents both a current (hereinafter referred to as "an emission current") flowing into the collector from the emitter cone 6 and a current (hereinafter referred to as "a gate current") flowing into the gate electrode from the emitter cone 6. As is clear from FIG. 3, when the collector voltage is relatively low, the emission current flows in relatively small amount and electrons flowing into the gate electrode 3 tend to increase. When the gate current is to enter the gate electrode 3, the field causes the gate current to enter the gate electrode at an area (hereinafter referred to as "an opening area 13". See FIG. 1D) around the tip end of the cavity 4. This is obvious in view of the fact that sites of bombardment with electrons can be observed at the opening area 13 in external appearance of a field emission type cold cathode having been operated with the collector voltage being reduced.

FIG. 4 is a cross-sectional view of a conventional electron gun including a hot cathode 22. FIG. 4 in particular shows positional relationship between electrodes and the hot cathode 22. An electron gun as illustrated is used for a cathode ray tube (CRT), for instance (hereinafter, such an electron gun is referred to as "CRT electron gun"). The internal structure of the hot cathode 22 and a heater for heating the hot cathode 22 are omitted in FIG. 4 for the sake of clarity. In FIG. 4, the potential distribution observed when the electron gun operates is shown with equipotential lines 21. Only the potential distribution contributing to the emission of the hot cathode 22 is illustrated. In FIG. 4, an electrode located closest to the hot cathode 22 is called a first electrode 11, and an electrode located second closest to the hot cathode 22 is called a second electrode 12. The other elements of CRT including a frame supporting the hot cathode 22, the first and second electrodes 11 and 12 are omitted, because they are unnecessary for explanation of the operation of the CRT electron gun.

In general, an aperture of the first electrode 11 is smaller in size than an electron-emission area of the hot cathode 22 in the CRT electron gun, and thus a voltage is applied to the electrodes of the CRT electron gun so that the equipotential lines 21 as illustrated in FIG. 4 are generated.

A hot cathode emits electrons in an amount in proportion to the 3/2-th power of a voltage applied onto a surface of the cathode. Accordingly, electrons are emitted only from an area of the hot cathode 22 which is near the aperture of the first electrode 11 and which is provided with higher voltage than that of the first electrode 11. Hereinafter, such an area is called an electron emission area 14.

Japanese Unexamined Patent Publication No. 4-284324 has suggested a field emission type cold cathode including a gate electrode having a resistance formed therein. FIG. 5 is a perspective view of this cathode. As illustrated, a gate electrode 3 in each device comprises a gate stay 18 having a resistance therein and a gate trunk 19 through which a voltage is applied to the gate electrode 3.

As having been mentioned earlier, if the collector voltage is relatively low, the gate current tends to increase. The potential drop caused by the increased gate current causes the gate voltage to be reduced with the result of reduction of the emission current.

A conventional method for mounting a hot cathode in the CRT electron gun has a problem in that it is impossible to apply a sufficient voltage to a gate due to the above mentioned voltage drop, resulting in that the CRT electron gun cannot operate. There is proposed a method of mounting a field emission type cold cathode only in a certain area on mounting the cathode into the CRT electron gun in order to prevent electrons from entering the gate electrode. However, this method needs to dispose the cathode so that there exists no eccentricity between the first electrode and the cathode, and hence is not practical. In addition, the cathode has another shortcoming in that if electrically conductive foreign material exists between the gate electrode and the emitter cone, the above mentioned voltage drop causes the gate voltage to be decreased with the result of degradation of the performance of the cathode.

Hereinbelow are explained some problems which occur when emitter cones in a field emission type cold cathode are divided into several groups. When the emitter cones are divided into several groups as illustrated in FIG. 2A, a cavity **4*a* disposed at the center in each of the groups is surrounded by the high-resistance layer 16 by the same distance. However, cavities 4*b* and 4*c* disposed not at the center of the group are surrounded by the high-resistance layer 16 by different distances. For instance, the cavity 4*b* is disposed quite near the high-resistance layer 16 as viewed in the left in FIG. 2B, but far away from the high-resistance layer 16 as viewed in the right. As illustrated in FIG. 1C, if the cavity 4 is unequally spaced away from the high-resistance layer 16 in the step of deposition of the refractory metal layer 10, the refractory metal layer 10 is not uniformly deposited with the result of a problem of non-uniform shapes of the emitter cones 6. Unless (a) the gate electrode 3 comprising the high-resistance layer 16 and the low-resistance layer 17 in a device as illustrated in FIG. 2B has a flat configuration, (b) the gate electrode 3 is axially symmetrical about the cavity 4 in a direction perpendicular to a direction in which electrons are emitted, namely in a traverse direction in FIGS. 2A and 2B, or (c) the cavity 4 is sufficiently spaced away from the low-resistance layer 17, it is not possible to uniformly deposit the refractory metal layer 10 on the gate electrode 3 in the step of forming the emitter cone 6, and thus it is not possible for the holes 10*a* of the refractory metal layer 10 to uniformly close about a central axis of the cavities 4. In order to avoid such a problem in the field emission type cold cathode disclosed in Japanese Unexamined Patent Publication No. 5-144370, it is necessary to dispose the high-resistance layer 16 spaced sufficiently far away from the cavity 4**, which however accompanies reduction of a density of arranging emitter cones. In addition, if emitter cones are divided into several groups as illustrated in FIG. 2A, a distance between an emitter cone disposed at the center of each of the groups and the low-resistance layer is different from a distance between emitter cones disposed not at the center of the group and the low-resistance layer, resulting in dispersion in voltage drop.

In an application in which cathodes are incorporated in an electron gun such as CRT, emitter cones disposed out of the electron emission area 14 (FIG. 4) are inoperable. In general, the electron emission area in an electron gun to be used for CRT has a diameter ranging from 150 μm to 300 μm, which diameter is now being decreased in newly developed electron guns. A pitch between emitter cones in a conventional field emission type cold cathode is a few micrometers, and hence, if emitter cones are divided into 3×3 groups, each of the groups is sized at least 20 μm×20 μm. Thus, if emitter cones are to be divided into several groups, emitter cones disposed out of the electron emission area 14 cannot emit electrons. In addition, when three electron guns are to be used for red (R), green (G) and blue (B), emitter cones disposed in a cathode arranged in each of the electron guns are not uniformly operable with the result of dispersion in emission to be obtained.

In a conventional method as illustrated in FIG. 5 in which the gate stay 18 acting as a resistance is formed as a part of the gate electrode 3, it is necessary to dispose the gate stay 18 sufficiently spaced away from the cavity 4, resulting in that it is not possible to arrange emitter cones in higher density.

SUMMARY OF THE INVENTION

It is an object of the present invention to provide a field emission type cold cathode which is able to prevent an emitter cone from becoming inoperable due to gate potential drop, even if a cathode contains an area at a surface thereof to which anode voltage is not sufficiently applied, or even if a gate electrode is short-circuited with a substrate due to electrically conductive foreign material entering in a cavity.

Another object of the present invention is to provide a field emission type cold cathode which does not need to align an electrode with a cathode in a direction perpendicular to a direction in which electrons are to be emitted, when the cathode is to be applied to an electron gun which non-uniformly applies an anode voltage to a surface of a cathode.

A further another object of the present invention is to provide an electron gun including a field emission type cold cathode as mentioned above.

In one aspect, the present invention provides a field emission type cold cathode including (a) a substrate which is electrically conductive at least at a surface thereof, (b) at least one emitter cone disposed on the substrate, the emitter cone having a sharp tip end, (c) a gate electrode having at least one cavity in which the emitter cone is to be disposed, and (d) an insulative layer interposed between the substrate and the gate electrode. A first area of the gate electrode around the tip end of the emitter cone is characterized by having different characteristics with respect to potential drop from a second area of the gate electrode other than the first area.

The first area can have different characteristics with respect to potential drop from the second area in various ways. For instance, the first area of the gate electrode is made of different material from material of which the second area is made. For another instance, the first area of the gate electrode has different electrical resistance from that of the second area.

As an alternative, the gate electrode may include first and second conductive layers. The first conductive layer lies on the insulative layer and the second conductive layer lies on the first conductive layer. The cavity includes a first opening formed in the first conductive layer and a second opening formed in the second conductive layer, the first opening being coaxial with the second opening and having a smaller inner diameter than that of the second opening. In this configuration, an area of the first conductive layer which is exposed outside or is not covered with the second conductive layer acts as the first area.

The area A of the gate electrode is preferably annular in shape.

For instance, the first conductive layer may be made of polysilicon, and the second conductive layer may be made of refractory metal such as tungsten (W) and tungsten silicide (WSi). The first conductive layer is doped preferably with fewer impurities than the second conductive layer.

In another aspect, the present invention provides an electron gun including a cathode, and a plurality of control electrodes disposed in alignment with the cathode so that electrons emitted from the cathode are directed towards the control electrodes. The cathode having been mentioned above may be used as a cathode constituting a part of the electron gun.

In the field emission type cold cathode made in accordance with the present invention, the above mentioned first area of the gate electrode makes it possible to stably operate the cathode without reduction of voltage of the gate electrode, even if electrons flow into the first area of the gate electrode in some emitter cones in a field emission type cold cathode having a plurality of emitter cones arranged in an array.

In addition, the formation of the first area makes it possible to electrically separate cathodes in which electrons flow into a gate electrode from others, and hence it is possible to stop operation of the minimum number of cathodes to thereby avoid degradation of electron emission distribution of a cathode.

Furthermore, the present invention makes it possible to use a cathode having an electron emission area larger than an area of an opening formed in an electrode of an electron gun, thereby alignment of a cathode with an electron gun in axes thereof can be readily made.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1A:
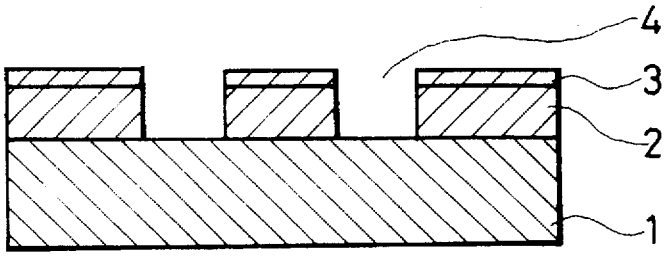
FIG. 1A PRIOR ART
FIGS. 1A to 1D are cross-sectional views showing respective step in a method of fabricating a field emission type cold cathode, which method was suggested by C. A. Spindt.
Figure 1B:
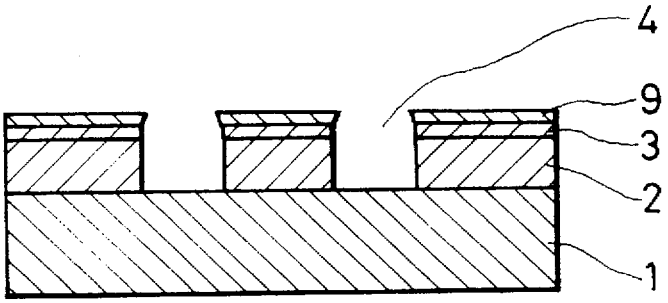
FIG. 1B PRIOR ART
Figure 1C:
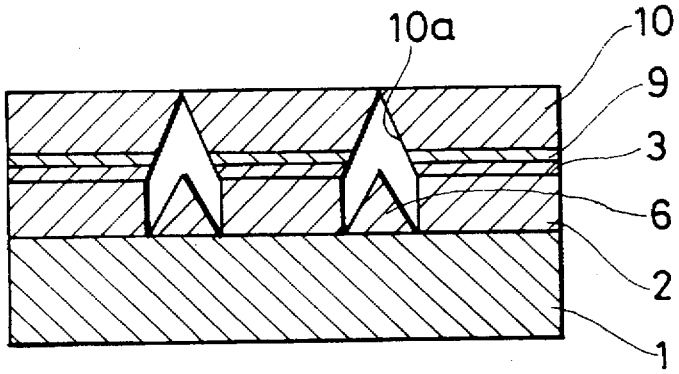
FIG. 1C PRIOR ART
Figure 1D:
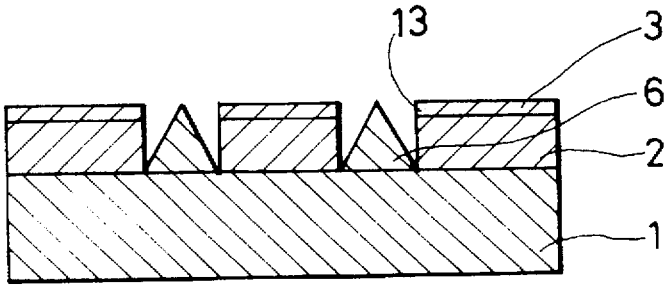
FIG. 1D PRIOR ART
Figure 2A:
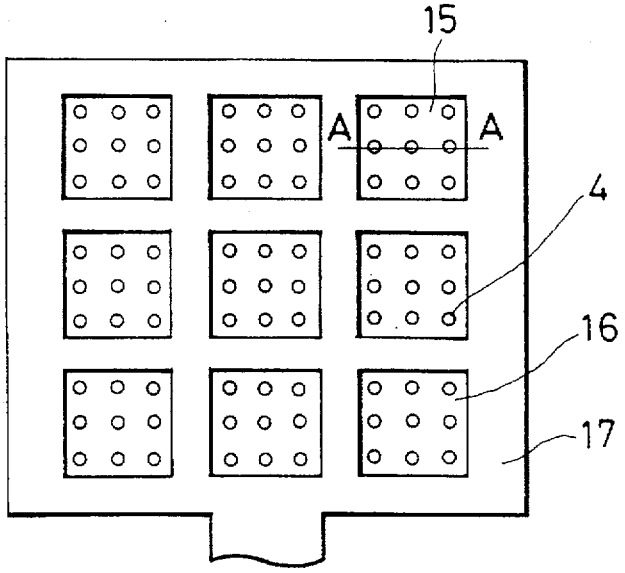
FIG. 2A PRIOR ART
FIGS. 2A and 2B are plan and cross-sectional views, respectively, illustrating a field emission type cold cathode disclosed in Japanese Unexamined Patent Publication No. 5-144370.
Figure 2B:
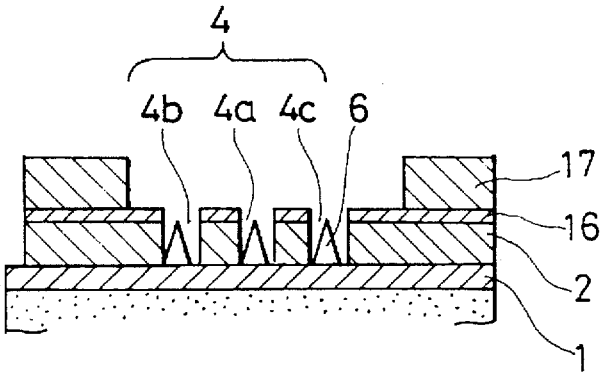
FIG. 2B PRIOR ART
Figure 5:
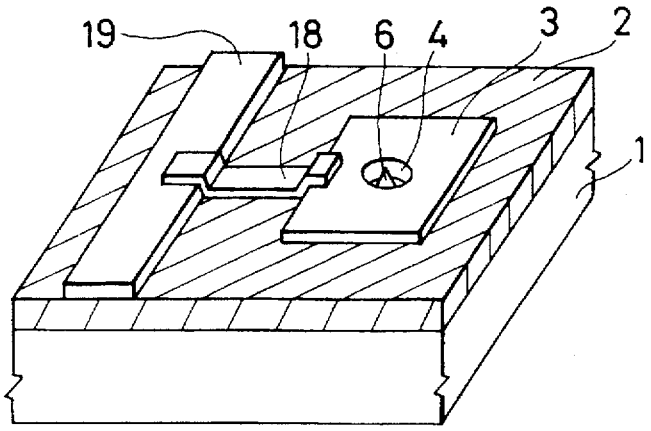
FIG. 5 PRIOR ART
FIG. 5 is a perspective view illustrating a field emission type cold cathode disclosed in Japanese Unexamined Patent Publication No. 4-284324.
Figure 3:
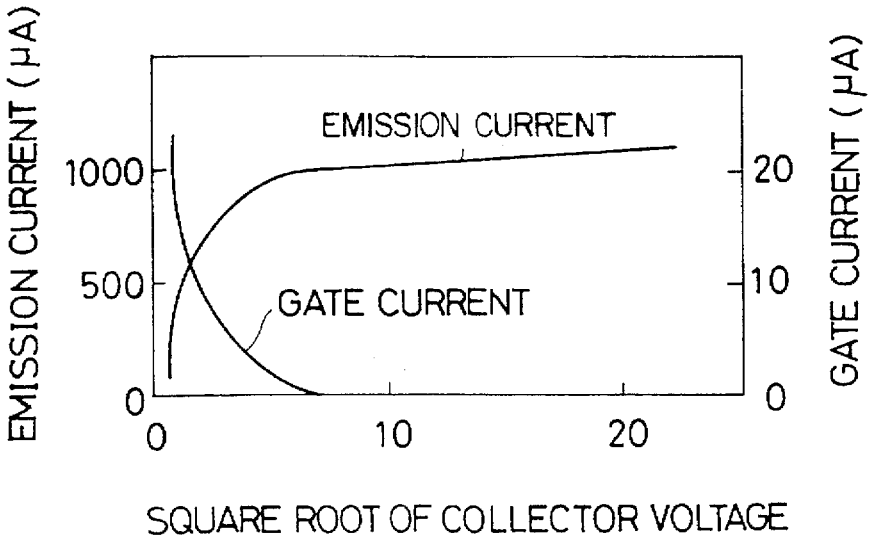
FIG.3 PRIOR ART
FIG. 3 is a graph showing operation characteristics of a field emission type cold cathode.
Figure 4:
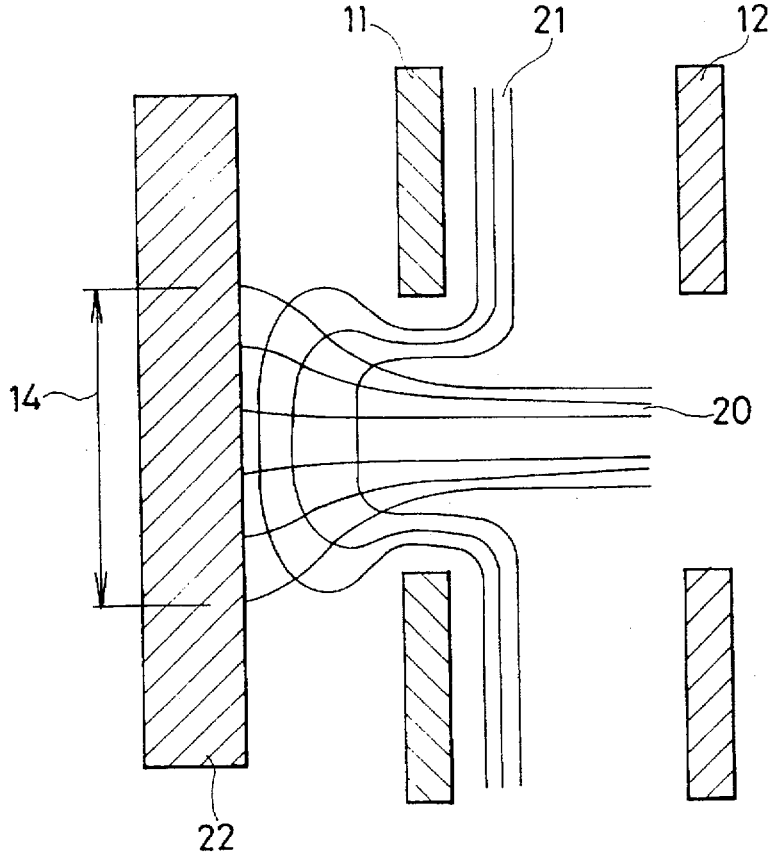
FIG.4 PRIOR ART
FIG. 4 is a cross-sectional view of a part of a conventional electron gun including a hot cathode and electrodes.
Figure 6:
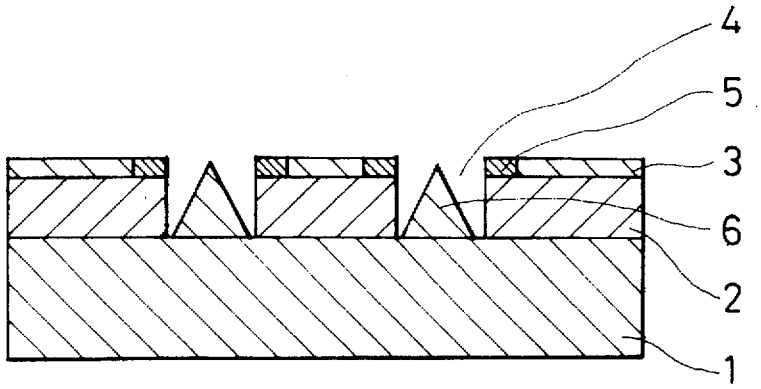
FIG. 6 is a cross-sectional view of a field emission type cold cathode fabricated in accordance with the first embodiment of the present invention.
Figure 7:
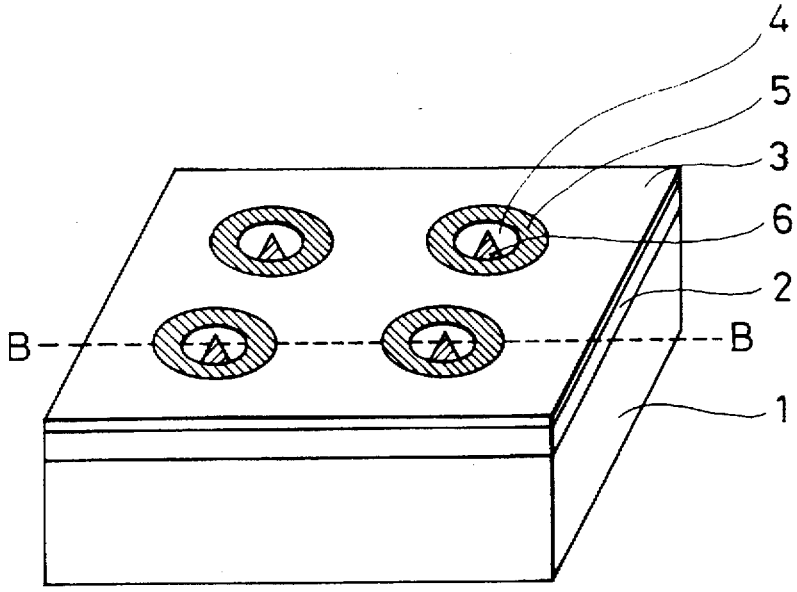
FIG. 7 is a perspective view of the cathode illustrated in FIG. 6.

FIGS. 6 and 7 illustrates a field emission type cold cathode fabricated in accordance with the first embodiment of the present invention. FIG. 7 is a perspective view, and FIG. 6 is a cross-sectional view taken along the line B—B in FIG. 7. As illustrated in FIG. 6, on an electrically conductive substrate 1 made of single crystal silicon Si is deposited by thermal oxidation or chemical vapor deposition (CVD) an insulative layer 2 composed of insulative material such as silicon dioxide and silicon nitride and having a thickness of 1 μm. In addition, on the insulative layer 2 is formed by CVD a gate electrode 3 composed of polysilicon film having a thickness of 0.3 μm. The gate electrode 3 is masked with a nitride film to thereby cover 2 μm diameter circular areas in which cavities 4 are to be formed, and then impurities are emitted into non-masked areas of the gate electrode 3 by ion-implanting to thereby impart conductivity to the gate electrode 3. Thus, a plurality of circular high-resistance areas 5 are formed in areas at which the cavities are to be formed.

Then, similarly to a conventional method of fabricating a field emission type cold cathode, the cavities 4 having a diameter of 1 μm are formed in the circular high-resistance areas 5 by photolithography and reactive ion etching (RIE). By forming the cavities 4, the high-resistance areas 5 are changed in shape into annular areas, as illustrated in FIG. 6.

Then, by carrying out vacuum evaporation and sacrifice layer etching, emitter cones 6 are formed. As illustrated in FIGS. 6 and 7, the annular high-resistance areas 5 are located just around tip ends of the emitter cones 6. Thus, a field emission type cold cathode is completed in accordance with the first embodiment.

As mentioned earlier, if sufficiently high anode voltage is applied to a cathode and further if there exists no conductive foreign material in the cavities 4, no gate current runs.

Accordingly, the voltage having been applied to the gate electrode 3 is also applied to the high-resistance areas 5, thereby the field emission type cold cathode is now able to operate.

Figure 8:
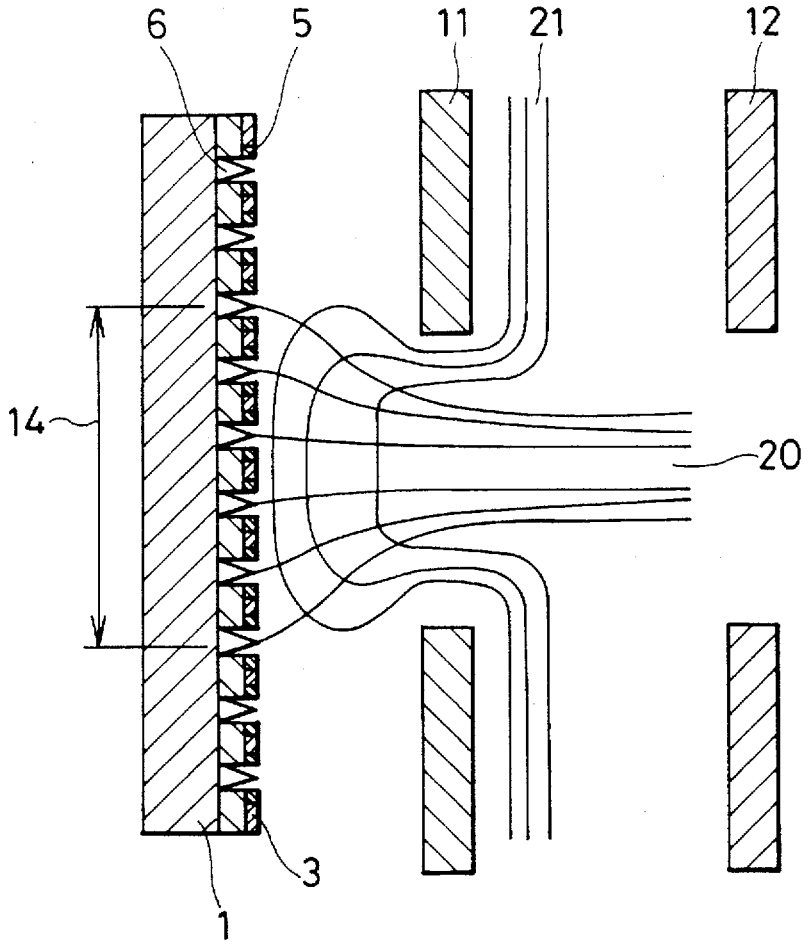
FIG. 8 is a cross-sectional view of an electron gun including the field emission type cold cathode fabricated in accordance with the first embodiment of the present invention.

FIG. 8 is a cross-sectional view of an electron gun which is to be used for CRT and to which is applied the field emission type cold cathode fabricated in accordance with the first embodiment. As illustrated, since an anode voltage is not applied to the cathodes disposed outside the electron emission area 14, electrons emitted from the emitter cones 6 enter a sidewall of the cavities 4, and thus, potential drop occurs due to the high-resistance areas 5, resulting in that an electric field is no longer exerted on the tip ends of the emitter cones 6. Thus, whereas the cathodes disposed outside the electron emission area 14 do not operate, only the cathodes disposed within the electron emission area 14 can operate.

Figure 9:
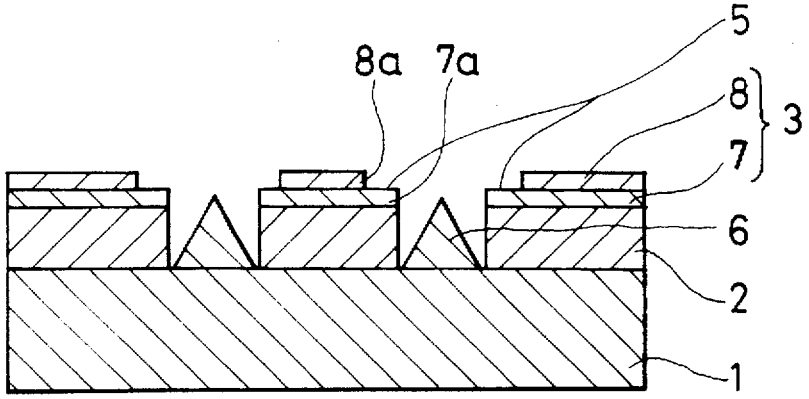
FIG. 9 is a cross-sectional view of a field emission type cold cathode fabricated in accordance with the second embodiment of the present invention.
Figure 10:
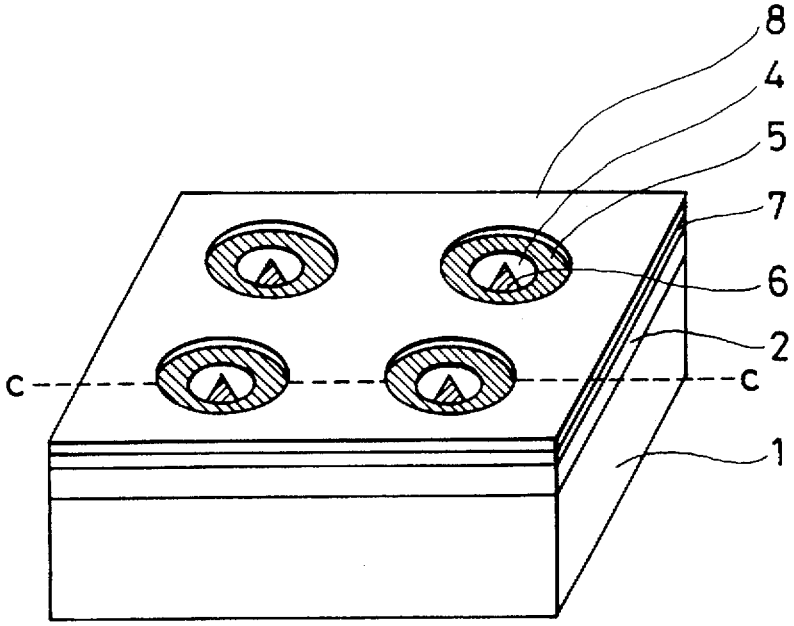
FIG. 10 is a perspective view of the cathode illustrated in FIG. 9.

FIGS. 9 and 10 illustrates a field emission type cold cathode fabricated in accordance with the second embodiment of the present invention. FIG. 10 is a perspective view, and FIG. 9 is a cross-sectional view taken along the line C—C in FIG. 10. As illustrated in FIG. 9, on an electrically conductive substrate 1 made of single crystal silicon Si is deposited by thermal oxidation or chemical vapor deposition (CVD) an insulative layer 2 composed of insulative material such as silicon dioxide and silicon nitride and having a thickness of 1 μm. In addition, on the insulative layer 2 is formed by CVD a first gate layer 7 composed of polysilicon film. The first gate layer 7 is lightly doped with impurities. On the first gate layer 7 is deposited a low-resistance second gate layer 8 by sputtering. The second gate layer 8 is made of refractory metal such as tungsten (W) or refractory metal compound such as tungsten silicide (WSi). The first and second gate layers 7 and 8 cooperate with each other to form a gate electrode 3.

By carrying out lithography and dry etching each twice, first and second openings 7*a* and 8*a* are coaxially formed in the first and second gate layers 7 and 8, respectively. The first opening 7*a* is formed so that it has a smaller inner diameter than an inner diameter of the second opening 8*a*. In this embodiment, the first opening 7*a* has an inner diameter of 1 μm, and the second opening 8*a* has an inner diameter of 2 μm.

Then, dry etching and wet etching is carried out to thereby form the cavities 4. Subsequently, similarly to a conventional method of fabricating a field emission type cold cathode, vacuum evaporation and sacrifice layer etching are carried out to thereby form the emitter cones 6. Thus, there is obtained a field emission type cold cathode in accordance with the second embodiment. It should be noted that an area of the first gate layer 7 which is exposed outside or is not covered with the second gate layer 8 acts as the high-resistance area 5.

Similarly to the application of the field emission type cold cathode fabricated in accordance with the first embodiment to an electron gun as illustrated in FIG. 8, it is also possible to apply the field emission type cold cathode fabricated in accordance with the above mentioned second embodiment to an electron gun.

As is obvious in view of the above description, the high-resistance area 5 of the gate electrode 3 makes it possible to stably operate the cathode without reduction of the gate electrode voltage, even if electrons flow into the area in some emitter cones in a field emission type cold cathode having a plurality of emitter cones arranged in an array.

In addition, the formation of the high-resistance areas makes it possible to electrically separate cathodes in which electrons flow into a gate electrode from others, and hence it is possible to stop operation of the minimum number of cathodes.

Furthermore, the present invention makes it possible to use a cathode having an electron emission area larger than an area of an opening formed in an electrode of an electron gun, thereby axial alignment of a cathode with an electron gun can be readily made.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A field emission type cold cathode comprising:

a substrate which is electrically conductive at least at a surface thereof;

at least one emitter cone disposed on said substrate, said emitter cone having a sharp tip end;

a gate electrode having a first area, a second area and at least one cavity in which said emitter cone is to be disposed, said first area surrounding said tip end of said emitter and extending from an edge of said cavity, said second area surrounding said first area; and an insulative layer interposed between said substrate and said gate electrode, said first area of said gate electrode having an electrical resistance value greater than an electrical resistance value of said second area of said gate electrode.

2. The field emission type cold cathode as set forth in claim 1, wherein said first area of said gate electrode is annular in shape.

3. The field emission type cold cathode as set forth in claim 1, wherein said first area of said gate electrode is made of a different material than a material from which said second area is made.

4. The field emission type cold cathode as set forth in claim 3, wherein said first area of said gate electrode is annular in shape.

5. The field emission type cold cathode as set forth in claim 1, wherein said first area of said gate electrode is annular in shape.

6. A field emission type cold cathode comprising:

a substrate which is electrically conductive at least at a surface thereof;

at least one emitter cone disposed on said substrate, said emitter cone having a sharp tip end;

a gate electrode having a first area, a second area and at least one cavity in which said emitter cone is to be disposed, said first area surrounding said tip end of said emitter and extending from an edge of said cavity, said second area surrounding said first area; and an insulative layer interposed between said substrate and said gate electrode, said first area of said gate electrode having an electrical resistance value greater than an electrical resistance value of said second area of said gate electrode, wherein said gate electrode comprises first and second conductive layers, said first conductive layer lying on said insulative layer and said second conductive layer lying on said first conductive layer, said cavity including a first opening formed in said first conductive layer and a second opening formed in said second conductive layer, said first opening being coaxial with said second opening and having a smaller inner diameter than that of said second opening, said first area corresponding to an area of said first layer disposed between said first and second openings, said second area corresponding to an area of said second layer.

7. The field emission type cold cathode as set forth in claim 6, wherein said first conductive layer is made of polysilicon.

8. The field emission type cold cathode as set forth in claim 6, wherein said first conductive layer is doped with fewer impurities than said second conductive layer.

9. The field emission type cold cathode as set forth in claim 6, wherein said second conductive layer is made of refractory metal.

10. The field emission type cold cathode as set forth in claim 6, wherein said second conductive layer is made of tungsten (W).

11. The field emission type cold cathode as set forth in claim 6, wherein said second conductive layer is made of tungsten silicide (WSi).

12. An electron gun comprising:

a cathode; and a plurality of control electrodes disposed in alignment with said cathode so that electrons emitted from said cathode are directed towards said control electrodes, said cathode including:

a substrate which is electrically conductive at least at a surface thereof;

at least one emitter cone disposed on said substrate, said emitter cone having a sharp tip end;

a gate electrode having a first area, a second area and at least one cavity in which said emitter cone is to be disposed said first area surrounding said tip end of said emitter and extending from an edge of said cavity, said second area surrounding said first area; and an insulative layer interposed between said substrate and said gate electrode, said first area of said gate electrode having an electrical resistance value greater than an electrical resistance value of said second area of said gate electrode.

13. The electron gun as set forth in claim 12, wherein said first area of said gate electrode is annular in shape.

14. The electron gun as set forth in claim 12, wherein said first area of said gate electrode is made of a different material than a material from which said second area is made.

15. The electron gun as set forth in claim 14, wherein said first area of said gate electrode is annular in shape.

16. The electron gun as set forth in claim 12, wherein said first area of said gate electrode is annular in shape.

17. An electron gun comprising:

a cathode; and a plurality of control electrodes disposed in alignment with said cathode so that electrons emitted from said cathode are directed towards said control electrodes, said cathode including:

a substrate which is electrically conductive at least at a surface thereof;

at least one emitter cone disposed on said substrate, said emitter cone having a sharp tip end;

a gate electrode having a first area, a second area and at least one cavity in which said emitter cone is to be disposed, said first area surrounding said tip end of said emitter and extending from an edge of said cavity, said second area surrounding said first area; and an insulative layer interposed between said substrate and said gate electrode, said first area of said gate electrode having an electrical resistance value greater than an electrical resistance value of said second area of said gate electrode, wherein said gate electrode comprises first and second conductive layers, said first conductive layer lying on said insulative layer and said second conductive layer lying on said first conductive layer, said cavity including a first opening formed in said first conductive layer and a second opening formed in said second conductive layer, said first opening being coaxial with said second opening and having a smaller inner diameter than that of said second opening, said first area corresponding to an area of said first layer disposed between said first and second openings, said second area corresponding to an area of said second layer.

18. The electron gun as set forth in claim 17, wherein said first conductive layer is doped with fewer impurities than said second conductive layer.

* * * * *